US011594407B2

(12) United States Patent
Javahery et al.

(10) Patent No.: US 11,594,407 B2
(45) Date of Patent: Feb. 28, 2023

(54) SAMPLE INTRODUCTION SYSTEM FOR MASS SPECTROMETRY

(71) Applicant: Quadrocore Corp., Toronto (CA)

(72) Inventors: Gholamreza Javahery, Thornhill (CA); Ali Sepehri Fard, King City (CA)

( * ) Notice: Subject to any disclaimer, the term of this patent is extended or adjusted under 35 U.S.C. 154(b) by 0 days.

(21) Appl. No.: 17/474,979

(22) Filed: Sep. 14, 2021

(65) Prior Publication Data

US 2022/0084805 A1 Mar. 17, 2022

Related U.S. Application Data

(60) Provisional application No. 63/077,759, filed on Sep. 14, 2020.

(51) Int. Cl.
*H01J 49/00* (2006.01)
*H01J 49/04* (2006.01)

(52) U.S. Cl.
CPC ..... *H01J 49/0422* (2013.01); *H01J 49/0468* (2013.01)

(58) Field of Classification Search
CPC ... H01J 49/0422; H01J 49/0468; H01J 49/044
USPC ..... 250/281, 282, 288
See application file for complete search history.

(56) References Cited

U.S. PATENT DOCUMENTS 8,546,750 B2 * 10/2013 Jolliffe ..... H01J 49/06 250/281

* cited by examiner

*Primary Examiner* — Michael Maskell
(74) *Attorney, Agent, or Firm* — Nasser Ashgriz; UIPatent Inc.

(57) ABSTRACT

A surface interaction sample introduction (SISI) system for mass spectrometers is disclosed that improves sensitivity and reduces chemical background. SISI comprises of a settling chamber with an inlet orifice that ions created by an ionization source enter the MS impinging surface that is located in front of the inlet orifice, thereby the high-speed gas jet entering the settling chamber from the inlet orifice impinges on the impinging surface resealing ions and molecules into the settling chamber. The impinging surface can be one of the settling chamber surfaces or an extra surface placed inside the settling chamber. The impinging surface can be orthogonal or angled with respect to the gas jet. The impinging surface is heated to apply thermal energy to the jet to promote the liberation of ionized particles from attached impurities. The released ions and molecules leave the settling chamber from an outlet port towards a mass spectrometer inlet.

6 Claims, 8 Drawing Sheets

SAMPLE INTRODUCTION SYSTEM FOR MASS SPECTROMETRY

FIELD OF THE INVENTION

The present invention relates generally to mass spectrometry and more particularly to an interface for providing particles to a mass spectrometer.

BACKGROUND OF THE INVENTION

Mass spectrometer (MS) are used to determine a molecular weight and structural information about chemical compounds. Molecules are weighed by ionizing the molecules and measuring the response of their trajectories in a vacuum to electric and magnetic fields. Ions are weighed according to their mass-to-charge (m/z) values. In order to achieve this, a sample that is to be characterized, is ionized and then injected into the mass spectrometer. Atmospheric pressure ionization (API) is a popular method of generating ions at atmosphere and above pressure. API sources are advantageous because they provide a gentle means for ionizing molecules without inducing energy into the internal structures of molecules of interest hence keeping its integrity of the ground sate structure. They also provide ease of use because samples can be introduced at atmospheric conditions. Some common atmospheric pressure ion sources include Electrospray or nebulization assisted Electrospray (ES), Atmospheric Pressure Chemical Ionization (APCI), Atmospheric pressure Photo Ionization (APPI), and Matrix Assisted Laser Desorption Ionization (MALDI), Inductively couple plasma (ICP). These ion sources produce charged particles, such as protonated molecular ions or intact ions. Generally, ionization process is not efficient and unwanted cluster molecule ions are formed as well from analyte species in solution or solid form, in a region which is approximately at atmospheric pressure.

Mass spectrometers generally operate in a vacuum maintained lower than $10^{-4}$ Torr depending on the mass analyzer type. Therefore, charged particles must be transported into vacuum for mass analysis. Typically, a portion of the ions created in the API sources are entrained in a bath gas API source chamber and transported into vacuum along with a carrier gas through an orifice into vacuum. Doing this efficiently presents numerous challenges. In addition, API sources produce high chemical background and relatively low sensitivity. This results in a poor signal-to-noise ratio. This is believed to be caused by sampling of impurities attached to analyte ions (for example, cluster molecules, atoms or ions, or other undesired adducts), caused by incomplete desolvation during the API process. Many solvated droplets enter the mass spectrometer and consequently produce a large level of chemical noise across the entire mass range. Additionally, incompletely vaporized droplets linger near the sampling orifice.

The prior art discloses a wide variety of techniques to direct material from the ion source to the MS. Generally, there are numerous pressure regions with appropriate ion guides are introduced for transporting the charged species into the vacuum where mass analyzer is operational. A low-pressure interface is used between the atmospheric ion source and the next pressure region. Gases with molecules and ions first enter the interface through an inlet orifice and then exit the interface through an exit orifice towards the next stage or the MS. The design of the interface is critical for sensitivity and performance of the MS. The shape and the size of the inlet orifice as well as the pressure inside determine the characteristics of the gas. Generally, when mixture of flow of background gas and charged species enter the lower pressure regions, a supersonic expansion, normally refer to as free jet expansion, naturally forms, which has unique characteristics. One of its characteristics is a sever drop in temperature, which causes infusion of the particles. Direct sampling from this free jet expansion has multiple disadvantages namely, formation of clusters and allowing larger species enter the MS device reflecting in lower sensitivity and higher background noise. Additionally, photons and meta-stable neutrals can readily enter the mass analyzer causing false counts when they strike the detector, which is normally situated at the end of the mass analyzer.

A sample introduction system is one of the main components of a mass spectrometer. This interface is used to transport sample ions from an ionization source to the mass spectrometer entrance through a series of differentially pumped vacuum stages. Ion guides or rings are also used to properly direct the ions towards the entrance of the mass spectrometer. Such interfaces are critically important when using an atmospheric pressure ionization (API) source, in which the atmospheric pressure source is connected to the first stage of the vacuum ion guide system. Usually in an expanded jet with complex composition, a complex expansion and shock structure is formed. This results in a poor ion transmission efficiency and significant ion losses during transport from the atmospheric pressure source to the low-pressure ion guide. A large portion of the ion loss occurs during transit through the first vacuum region, where there is a strong gas dynamic effect and less effective droplet desolvation (in the case of atmospheric ionization source) due to the low temperatures caused by the gas flow expansion.

The present system is a new surface interaction sample introduction (SISI) for mass spectrometry. There are basically two main types of atmosphere-to-vacuum interfaces. One is an orifice-based interface, and the other is a heated capillary-based interface. A skimmer and/or an ion guide/funnel usually follows the interface for ion focusing. Other types of interfaces are mainly modifications based on these two types, for example, introducing a heated cone gas (or a heated gas curtain), increasing orifice or capillary numbers, coupling the heated capillary with an orifice interface, etc.

The ion source (not shown) is enclosed in a chamber that is maintained at approximately atmospheric pressure. The ion source can be an electrospray (ESI), ion spray, a MALDI, a corona discharge device, an atmospheric pressure chemical ionization (APCI) device, an atmospheric pressure photo ionization (APPI), Inductively Coupled Plasma (ICP) device, or any other known ion source. The pressure difference between the jet and the chamber is usually low enough to result in under-expanded jets. These jets have complex flow structure with a set of diamond shaped expansion waves and shock waves, and zones of silence in the inner parts of the jet to bring the gas pressure to the chamber pressure. The gas flow dynamics in the first vacuum region is of fundamental importance for the transport of ions. In a supersonic nozzle of a mass spectrometer interface, the gas flow expansion downstream of the orifice depends on both the inlet/outlet pressure ratio and the geometry of the nozzle. One of the remarkable characteristics of flow through the orifice interface is a strong flow expansion and ion transport through the Mach disk. These jet flow patterns result in significant ion deceleration. In the zone of silence there is a low frequency gas-ion collision which results in a narrow ion beam and localized decrease in the ion charge density. Downstream of the Mach disk, ions are decelerated and aggregate. The zone of silence is not beneficial for the transmission of highly charged ions of the same mass. The interaction of the flow circulation and the shock wave results in a zone of silence.

In many sample introduction systems, the jet is aimed at the entrance of the MS. This disrupts the expansion waves, and the material inside the wave enters the MS. The issue with these types of systems is that the pressure and temperatures inside the expansion waves becomes very low (in order of several kelvins), which results that the sample enters the MS at very low temperatures. The low temperature basically means that there is very low molecular mobility. These low pressure and temperatures may alter the sample characteristics.

U.S. Pat. No. 8,546,750B2, discloses a new sample introduction system in which the jet does not enter the MS directly, the details of which is incorporated in this application. In that patent, the flow goes through several bends causing that the expansion waves are died down before entering the MS. This system, referred to as Hot Source Induced Disolvation (HSID) tends to destroy the free jet expansion. The region of the free expansion is complicated. A skimmer body may also be positioned along the direction allowing ions of mass spectrometer interface to be sampled through orifice along the direction of the flow.

The two common methods of guiding the free expansion until the sampling point are using a ring guide and using an RF ion guide. These have many disadvantages: These include: (i) Clustering, which is due to low temperate. The clustering is combination of different ions and molecules. (ii) High chemical background, which is again because of formation of clusters. Since different molecule masses cluster, it is not possible to recognize the molecule. (iii) Requires frequent cleaning because it is cold and when the material comes out of this zone it sticks to the surfaces since they are so cold. (iv) Large difference from one system to another due to strong dependency of nozzle shape and form to free jet expansion profile. (v) Sever signal fluctuation. Since the MS is sensitive to contamination, any type of contamination of any form, such as clustering, will significantly change MS sensitivity. (iv) photons and meta-stable neutrals readily enter the MS device. In addition, the use of capillary influences the MS signal. The fluid conductance through the capillary can change the MS signal. Smallest variation in the capillary diameter can change the flow conditions and therefore MS signal. There can be a factor of 4 difference in sensitivity.

These are the so called "On Axis" system, where the MS entrance is coaxial in front of the orifice. In these systems the clusters can go through the MS, especially meta stable ones, which are damaging to the MS signal and cause MS problems.

Based on the above discussion, the prior art has the following disadvantages: On-axis sampling causes light and heavy molecules to enter the MS device causing high background noise. Sampling directly from the free jet expansion causing cluster charged species to be form due to the low temperature of expansion and hence high background noise. The free jet expansion is very sensitive to geometry of the sampling orifice. The changes to sampling orifice by contamination has a prominent effect in the expansion profile causing signal instability and fluctuation. Multiple bend in case of HSID, reduce sensitivity due to charge particle are forced to travel within narrow and long tunnels so that they have high probability of striking the surface area of the tunnels and lose their charges The present device provides a novel interface for atmospheric pressure ionization sources that improves mass spectrometer performance.

SUMMARY OF THE INVENTION

A new surface interaction sample introduction (SISI) system and method is disclosed to supply ionized particles (having characteristic mass to charge (m/z) ratios) of a sample to a mass spectrometer. The new system comprises of a settling chamber with solid surfaces that is connected to the ionization source through an inlet orifice from one side and has an outlet port that is not coaxial to the inlet orifice. Thereby, a gas jet containing molecules and ions that enters the interface impinges on a hot surface of the settling chamber causing the free jet expansion to lose its profile. In addition, the temperature of the flow of gas and ions increases rapidly allowing for further declustering and preventing the large solvated charged species to desolvate efficiently before entrance to the mass spectrometer. Unwanted photons and meta-stable neutrals are prevented from entering the mass analyzer.

The present interface provides off axis sampling, offering a high signal-to-noise ratio, with increased sensitivity and reduced chemical background, particularly using high liquid flow rates, by improving the efficiency of liberating attached impurities such as cluster molecules, atoms, ions or adducts.

The advantages of the present SISI system are: Off-axis sampling prevents light and heavy molecules enter the MS device; avoiding direct sampling from the free jet expansion significantly improves the signal stability and reproducibility; striking the mixture of gas and charged species to a hot surface in a settling chamber improve further desolvation therefore enhances sensitivity and reduce chemical noise; destruction of free jet expansion by a hot surface once and directing the charged species towards the exit of the settling chamber by the natural flow of the background gas significantly improves signal stability, reproducibility and sensitivity; charged species will enter the MS device under continuum flow of gas further increases signal stability, reproducibility and sensitivity, and SISI is simple, cost effective, easy to use and very low maintaining.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF THE INVENTION

Figure 1:
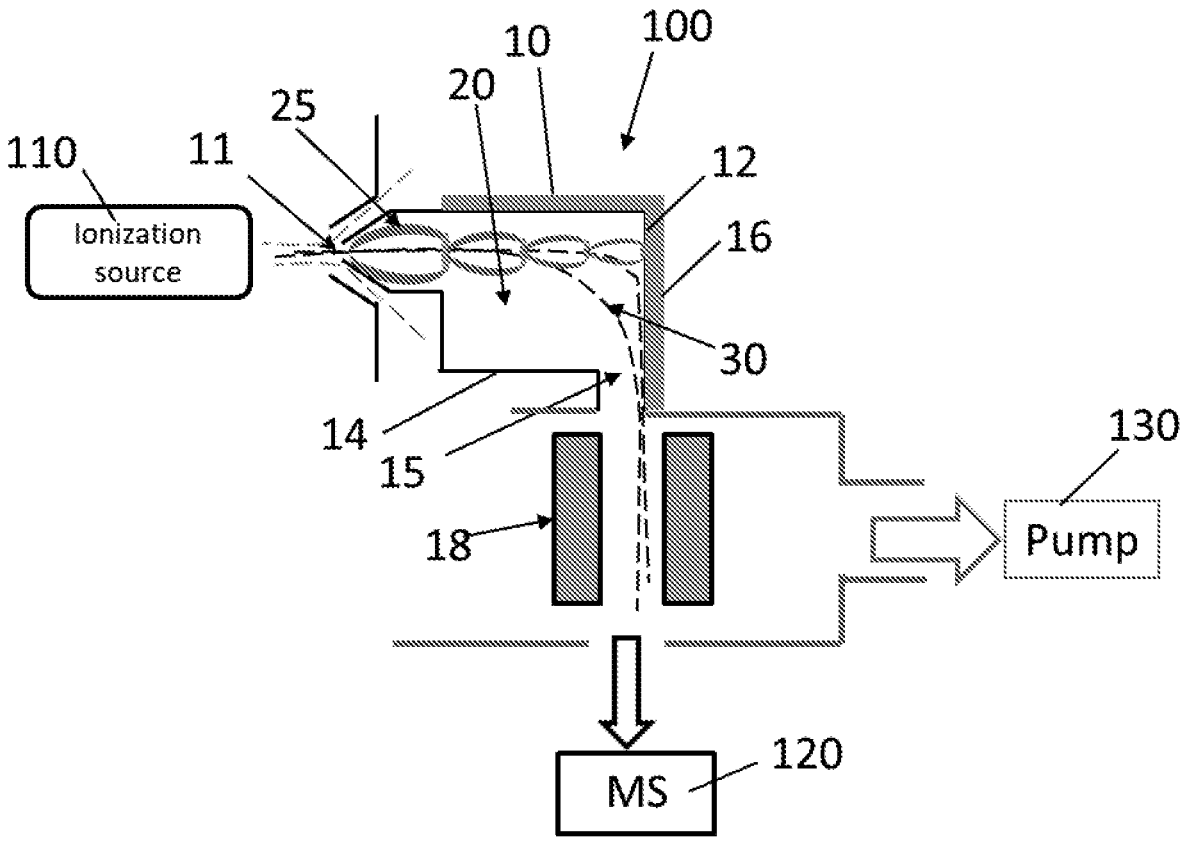
FIG. 1 shows SISI Surface Interaction Sample Introduction with an orthogonal sampling and with a ring guide/Ion funnel, and with no active pumping on SISI.

FIG. 1 shows the first embodiment of the Surface Interaction Sample Introduction (SISI) interface with Orthogonal sampling. SISI 100 is the interface between an ionization source 110 and a mass spectrometer 120, that may be a conventional mass spectrometer, including but not limited to quadrupole mass analyzers, magnetic sectors, hybrid and stand-alone time-of-flight devices, 2- and 3-dimensional ion traps, and Fourier transform mass spectrometers. SISI is designed to enhance concentration and sensitivity and reduce chemical background while providing the appropriate gas flow to a mass spectrometer system. In the embodiment of FIG. 1, the SISI interface comprises of a settling chamber 10 that has a cavity 20, and a sampling orifice 11, through which the sampling material are injected into the chamber. The sampling orifice diameter is typically is a fraction of millimetres, for examples 0.35 mm. The settling chamber 10 can be any shape and dimension but it is much larger in size than the sampling orifice. In one embodiment, the settling chamber has 10 to 50 mm sides. The settling chamber has an impacting surface 12 and an outlet surface 14, which has an outlet orifice 15. The outlet orifice diameter depend on the pumping capacity in this region, and it is normally from 0.2-2.0 mm.

Typically, the ionization source 110 is at atmospheric pressure, generating ions through different mechanisms, such as an electrospray, a MALDI, a corona discharge device, an atmospheric pressure chemical ionization device, an atmospheric pressure photo ionization device. Trace substances after ionization are injected into the interface typically with the aid of an inert gas. Ions and neutral gas molecules are transported from a high-pressure, typically an atmospheric pressure, through the sampling orifice 11, into a lower pressure of the cavity 20. When the ions and neutral gas expand into the cavity 20, a high speed jet flow is generated.

As the flow from the atmospheric pressure enters the settling chamber of the interface, which is at a lower pressure, a strong flow expansion occurs, which may have a diamond shape jet flow 25 with expansion waves and Mach disks. This jet flow pattern results in a significant ion deceleration. In the zones of silence (the zones bounded by the shock waves), there is a low frequency gas-ion collision, which results in a narrow ion beam and localized decrease in the ion charge density. Downstream of the Mach disks, ions are decelerated and aggregate. The zones of silence are not beneficial for the transmission of highly charged ions of the same mass.

Figure 2:
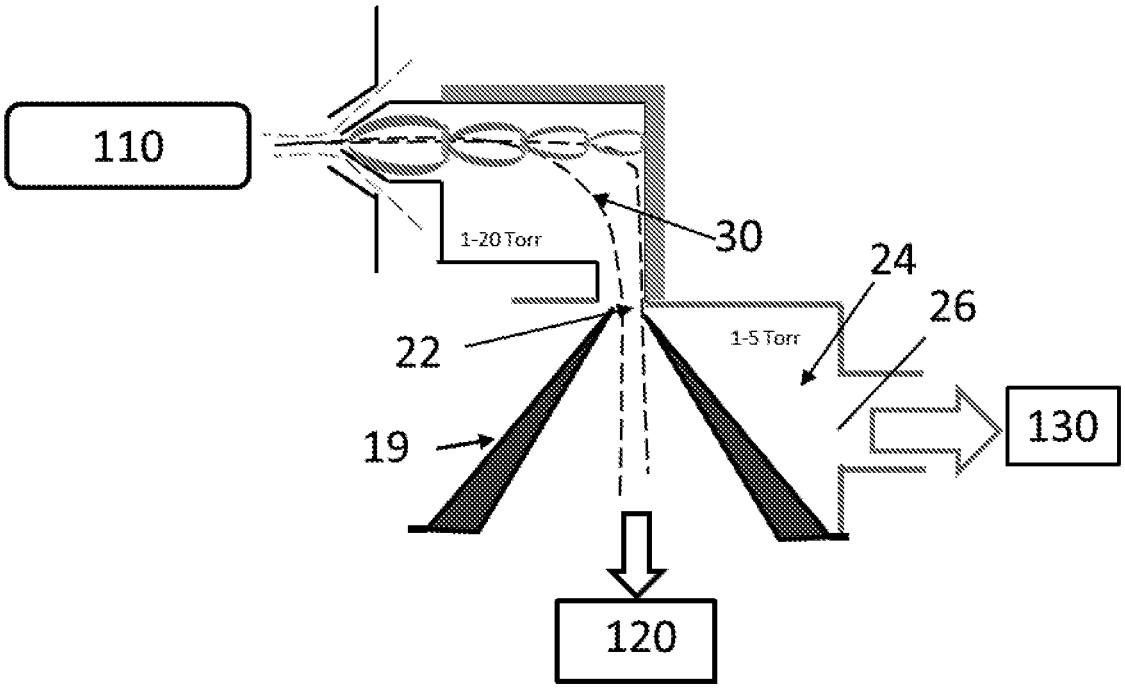
FIG. 2 shows SISI Surface Interaction Sample Introduction with an orthogonal sampling and a skimmer and no active pumping on SISI.

The settling chamber is configured such that the high speed jet flow impinges on one of its surfaces, i.e., the impinging surface 12. Once the jet impinges on the impinging surface 12, the expansion waves are destroyed, the molecules and ions in the gas are bounced off the surface and are quickly settled inside the cavity 20 of the settling chamber 10, reaching settling chamber pressure and temperature. The exit orifice of the settling chamber 15 is located such that a settled flow 30 flows through the orifice 15 at the settled conditions of the settling chamber. The impinging surface 12 is heated to rapidly normalized the low temperature conditions that exists at the central regions of the expansion waves. The pressure inside the settling chamber can be in the range of 1-20 Torr. However, the system can be configured to allow for other pressure conditions. A vacuum pump 130 controls the pressure inside the settling chamber and the flow of the ions out of the settling chamber. The pumping may be for example around 10 liters/second holding the average pressure in the range of 2 Torr. Upon impingement, ions and neutrals undergo gas-surface and gas-gas interactions in the cavity of the settling chamber to liberate at least some of the ionized molecules from attached impurities, such as neutral molecules, radicals, adducts, and other ions. This increases the concentration of desired ionized molecules with characteristic m/z ratios in the flow and reduces impurities that generate chemical background. The material exiting the settling chamber 10 from the exit orifice 15, enter the mass spectrometer 120. In one embodiment as shown in FIG. 1, an ion guide 18 guides the ion flow into the MS 120. As the gases exit the settling chamber the ion guide captures the ions and guides them into the MS and the rest of the material exit from the side of the system. In another embodiment as shown in FIG. 2, a skimmer 19 is used to sample the ions through its entrance 22 and guide them into the MS 120. The system can be configured to have RF ion guides, ring guides, ion funnels, skimmers, or other types of system for controlling and containing the ions. Sampled ions and neutrals are then transported through lower pressure region 24 into mass spectrometer 120. In both embodiments of FIGS. 2 and 3, the unsampled ions and neutral flow are evacuated through evacuation port 26.

The settling chamber has several purposes. One that the expansion waves impinge on a surface and are destroyed. Also, the settling chamber allows the mixture of neutral molecules and ions forming a constant flow inside the settling chamber, stabilizes ion to gas ratio for greater sensitivity and reproducibility. The outlet orifice 15 of the settling chamber allows the flow of neutral gas and entrained ions exit into the next stage of the mass spectrometer with a constant flow and minimum turbulent. The advantages of the settling chamber are as follows: Avoiding sampling from the free jet expansion by destruction of free jet expansion by a hot surface; low temperature of expansion rises to ambient temperature avoiding declustering; effective desolvation by heat dissipation from the hot surface; continuous flow of ions and natural gas improving signal stability, reproducibility and sensitivity; avoiding photons and meta-stable neutrals enter the mass analyzer; and greatly reducing instability of the MS device, which is highly susceptive to contamination.

Figure 3:
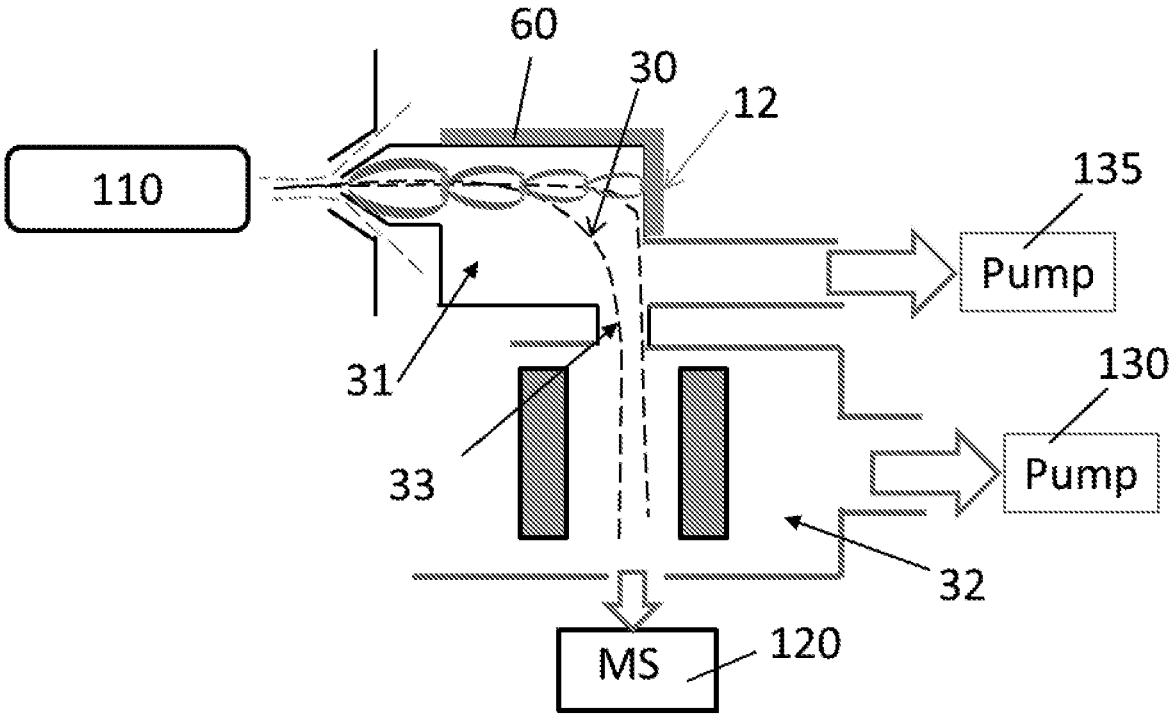
FIG. 3 shows SISI Surface Interaction Sample Introduction with orthogonal sampling and an active pumping on SISI.

In the embodiments shown in FIGS. 1 and 2 the pressure inside the settling chamber is less than 20 torr. However, in another embodiment, as shown in FIG. 3, a lower pressure settling chamber is disclosed, in which the pressures inside the settling chamber is less than 5 torr. In this embodiment, a secondary vacuum pump 135 is directly connected to the settling chamber 60. The secondary vacuum pump may be located at a position with a minimum influence on the settled flow 30. In some embodiments, the background pressure is between 1.0 to 50 Torr, but system with other pressures can be designed.

In configuration of FIG. 3, a settled flow of ions and neutral gas molecules 30 are transported from high-pressure settling chamber 31 (typically 1-5 Torr) through the orifice 33 to the second chamber 32 that is at a lower pressure (typically 50-200 mTorr). In the present system, the settling chamber 31 allows for the gas and ions to settle. The settling chamber 31 may have different shapes, however, it is significantly larger than the jet. The chamber (settling chamber) may be 4-10 mm. The expansion jet impinges on the front surface of the chamber and deflect downwardly towards the chamber exit hole at the bottom of the chamber. The impingement of the jet on the surface causes that the flow is disturbed and loses its shock structure. The flow becomes smoother with less turbulence before exiting the chamber. The ions and molecules may flow inside the chamber and settle down through mixing. Ions and neutrals undergo gas-surface and gas-gas interactions inside the chamber 31 to liberate at least some of the ionized molecules from attached impurities, such as neutral molecules, radicals, adducts, and other ions. This increases the concentration of desired ionized molecules with characteristic m/z ratios in the flow and reduces impurities that generate chemical background.

Figure 4:
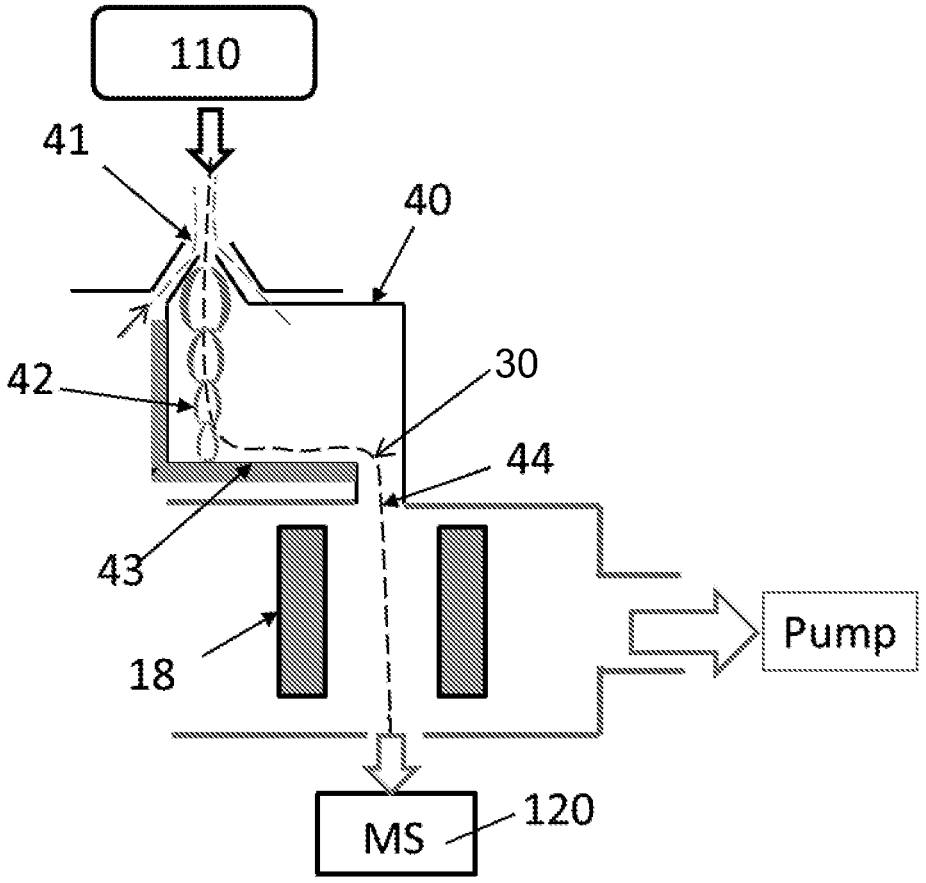
FIG. 4 shows SISI Surface Interaction Sample Introduction with off axis sampling and no active pumping on SISI.

FIG. 4 shows another embodiment of the current surface interaction sample introduction with off axis sampling and no active pumping. In this case, the injection point 41 is on the top of the settling chamber body 40. The jet 42 impinges on the bottom surface 43 of the settling chamber 40 and exits from an orifice 44 on the same plane 43. This is off-axis sampling. The ion guide 18 takes the ions into the mass spectrometer 120. In this embodiment of FIG. 4, the impinging surface 43 is heated by a heater.

Figure 5:
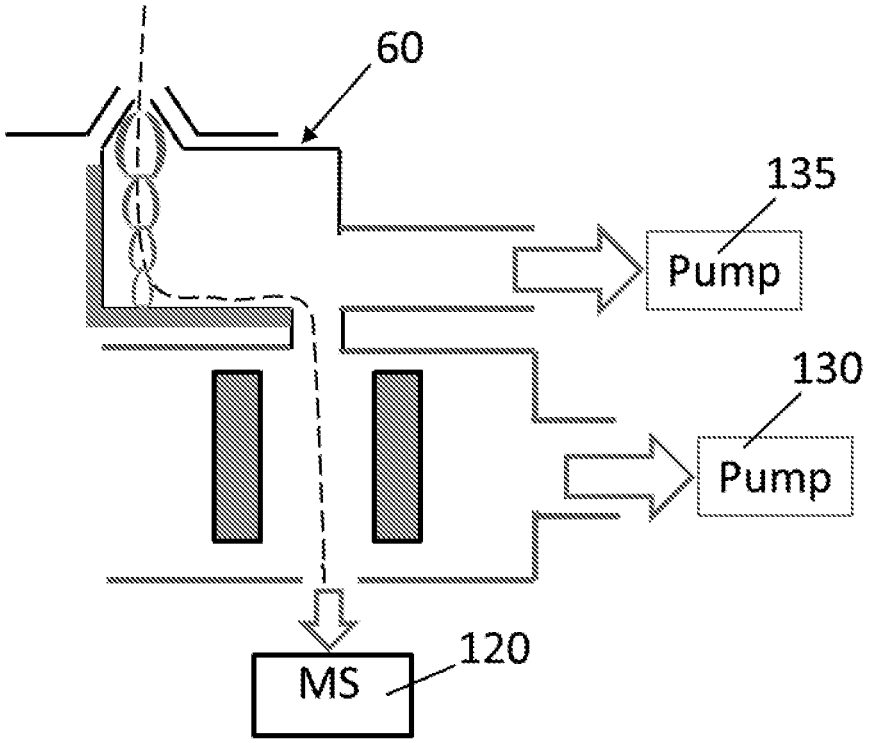
FIG. 5 shows the fifth embodiment of the present invention with off axis sampling and active pumping on SISI.

In another embodiment as shown in FIG. 5, the inlet 51 to the settling chamber 50 is at the top and substantially aligned with the exit orifice 52. A heating tube (or surface) 54 is located in front of the jet 55. The tube disturbs the jet as well as heating it. The heated gases and ions flow around the tube and towards the exit 52. Again, an ion guide 18 carries the ions towards the MS 120.

Figure 6:
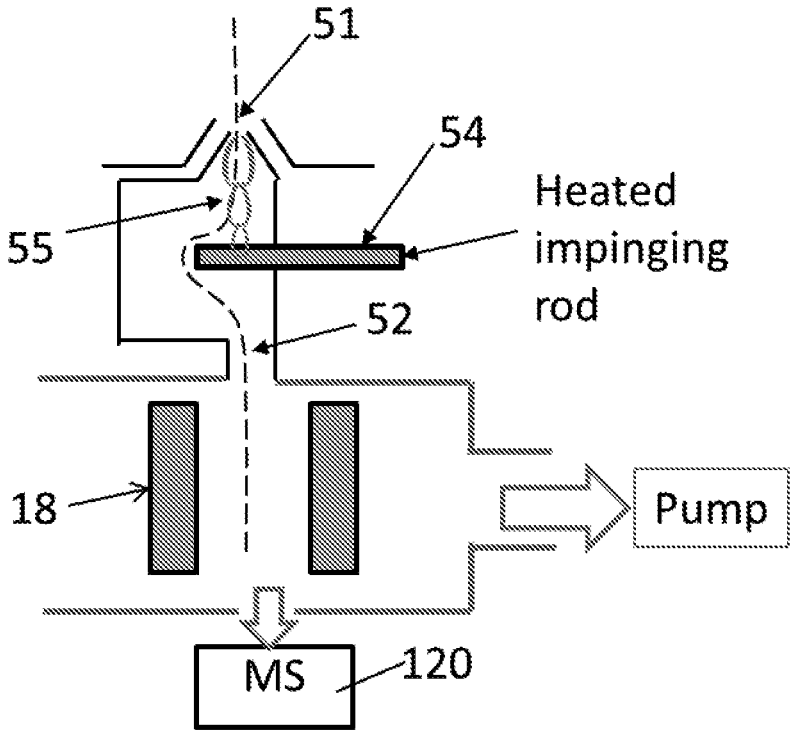
FIG. 6 shows the sixth embodiment of the present invention with a heated impinging rod set inside SISI.

FIG. 6 shows another embodiment of the surface interaction sample introduction 60 with off axis sampling, using active pumping on the settling chamber. A secondary vacuum pump 135 is connected to the settling chamber 60 to reduce the pressure inside the settling chamber.

Figure 7:
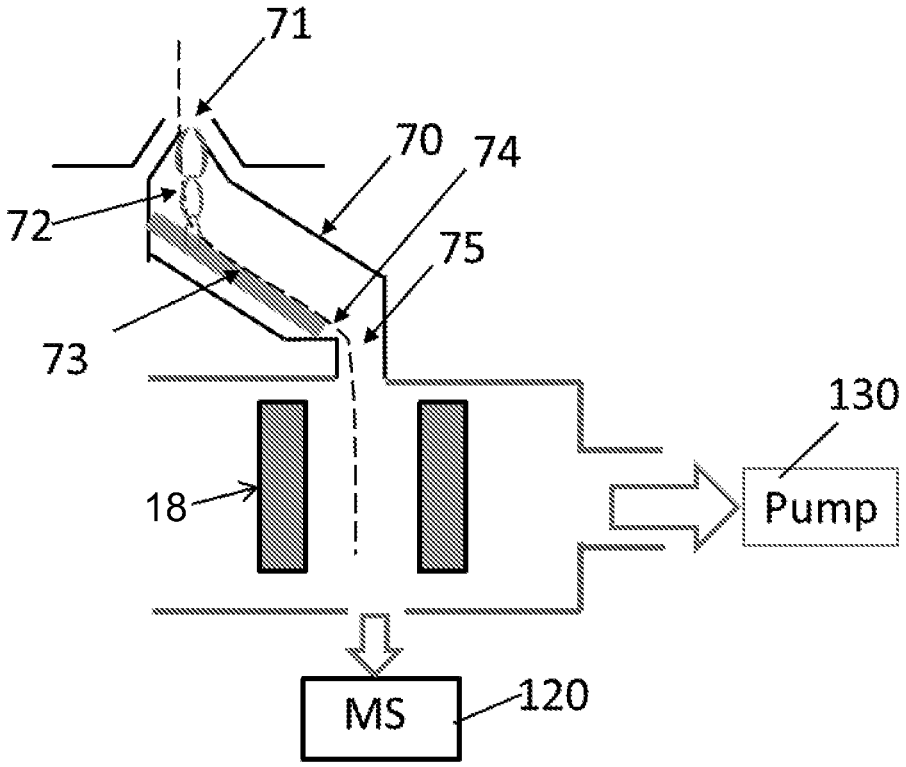
FIG. 7 shows the seventh embodiment of the present invention with an inclined impinging surface.
Figure 8:
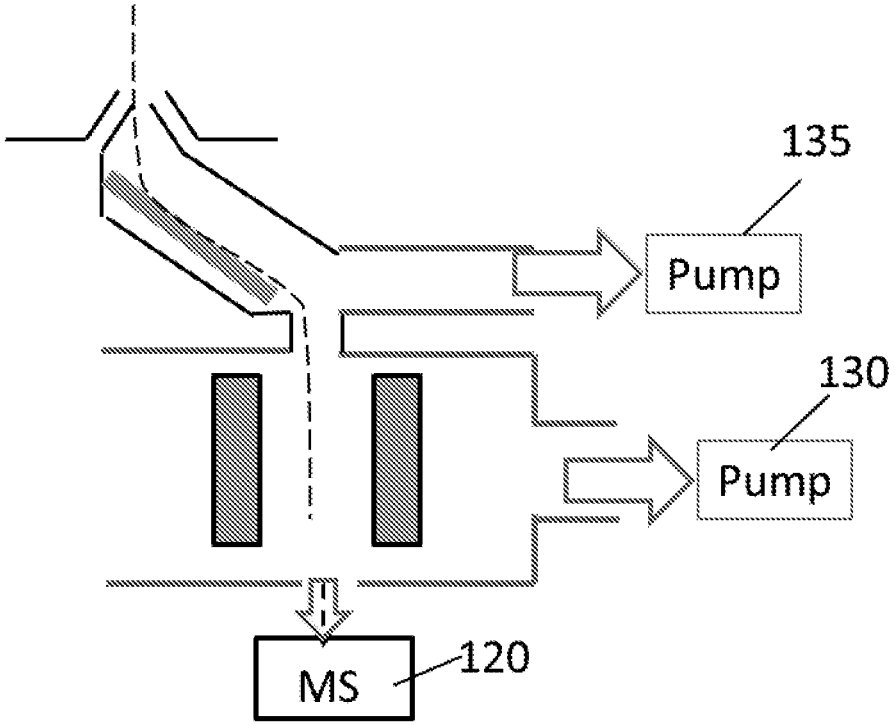
FIG. 8 shows the eighth embodiment of the present invention with an inclined impinging surface and an active pumping.

FIG. 7 shows another embodiment of the Surface Interaction Sample Introduction with an angled impinging surface. The inlet orifice 71 of the settling chamber 70 is at the top of the settling chamber. The jet 72 impinges of an angle impinging surface 73 and the settled flow 74 is directed towards the exit orifice 75 The impinging surface angel is 45° but it can be configure to be any other angle. The settling chamber may have no active pumping as in FIG. 7 or have active pumping 135 as in FIG. 8.

Other advantage of the present interface are that it improves desolvation; reduces background chemical noise; is entirely flow dominant, and there is nothing to adjust; requires no optimization; accommodates Liquid Chromatography (LC) flow rate of 100 to 3000 μl/min with equal respond; is a self cleaning interface, since the settling chamber is continuously hit by a jet that cleans it, and is easy to maintain and simple to operate.

The invention claimed is:

1. An interface between an ion source and a mass spectrometer for sample introduction to the mass spectrometer, comprising:

a settling chamber having an inlet orifice through which a sampling material is injected into the settling chamber, forming a jet flow inside the settling chamber, and having an outlet orifice on an outlet surface of the settling chamber to allow for a settled flow to flow from the settling chamber towards the mass spectrometer;

an impinging surface configured so that the jet flow impinges on the impinging surface, and the settled flow comprising of molecules and ions is formed inside the settling chamber, wherein the impinging surface is a tube with a predefined diameter that is located in between the inlet orifice and the outlet orifice, wherein the impinging surface disturbs and heats the jet flow and heated gases and ions flow around the impinging surface and towards the outlet orifice;

a heater to heat the impinging surface to heat the jet flow to prevent declustering and improve desolvation by heat dissipation, whereby the settled flow improves signal stability, reproducibility and sensitivity of the mass spectrometer.

2. The apparatus of claim 1, wherein the impinging surface is perpendicular or at an inclined angle with respect to the jet flow.

3. The apparatus of claim 1, wherein the settling chamber has 10 to 50 mm sides, and wherein the outlet orifice has a diameter in the range of 0.2-2.0 mm.

4. The apparatus of claim 1, wherein the inlet orifice and the outlet orifice are configured to control the pressure inside the settling chamber using a vacuum pump of the mass spectrometer.

5. The apparatus of claim 1, further having a secondary vacuum pump that is directly connected to the settling chamber to reduce the pressure inside the settling chamber.

6. The apparatus of claim 1, wherein the pressure inside the settling chamber is in the range of 1-20 Torr.

* * * * *